United States Patent [19]

O'Reilly

[11] 4,223,737

[45] Sep. 23, 1980

[54] METHOD FOR WELL OPERATIONS

[76] Inventor: Dale O'Reilly, 1006 Honey Hill, Houston, Tex. 77077

[21] Appl. No.: 23,540

[22] Filed: Mar. 26, 1979

[51] Int. Cl.[3] ..... E21B 7/12

[52] U.S. Cl. ..... 166/362; 166/350; 175/61

[58] Field of Search ..... 175/5, 7–10, 175/61, 62, 75; 166/352, 353, 360, 362, 367, 359

[56] References Cited

U.S. PATENT DOCUMENTS

| | | | |
|---|---|---|---|
| 2,565,794 | 8/1951 | Young | 175/65 X |
| 2,644,669 | 7/1953 | Curtis et al. | 175/61 X |
| 2,783,027 | 2/1957 | Gilbert | 175/5 |
| 2,988,144 | 6/1961 | Conrad | 166/362 X |
| 3,346,045 | 10/1967 | Knapp et al. | 166/362 X |
| 3,523,578 | 8/1970 | Nolan, Jr. et al. | 166/359 |
| 3,720,272 | 3/1973 | Hunter | 175/75 X |
| 4,003,440 | 1/1977 | Cherrington | 175/61 |

*Primary Examiner*—James A. Leppink
*Assistant Examiner*—Richard E. Favreau
*Attorney, Agent, or Firm*—Fulbright & Jaworski

[57] ABSTRACT

A method for handling pipe for drilling and well operations. The pieces of pipe to be used are connected together in a string above the surface of the medium, such as the earth or the seabed, into which they will be inserted. The pieces are connected so that the string lies in a substantially horizontal plane prior to insertion. The resulting string is then moved by a prime mover which moves in the horizontal plane. The string is moved into the medium at an angle near the horizontal. By employing suitable supports pre-assembled long length strings can be tested, inserted, and manipulated. Similarly, a complete string or large section thereof can be removed from a point of insertion such as a well bore without the necessity of disconnecting each separate member from the string. This method also accommodates the handling of single pieces of pipe.

4 Claims, 4 Drawing Figures

METHOD FOR WELL OPERATIONS

BACKGROUND OF THE INVENTION

1. Field of the Invention

The present invention relates to the field of methods of inserting pipe such as drillstring, casing and tubing into a well bore in the earth or the seafloor.

2. Description of the Prior Art

The resource reclamation industry, including the oil and gas industry, is oriented to the vertical handling of tubular members such as casing and tubing. In a typical operation, a lifting means lifts a single tubing section or a limited multiple section upright within a derrick framework and the tubing is then positioned above a hole, connected to the string of members already in place in the wellbore, and then lowered into the well bore. In some applications, a derrick is canted slightly from the vertical, but this does not produce any change in the typical mode of operation or result achieved other than to permit insertion at an angle that deviates slightly from the vertical. Drilling operations are similarly vertically oriented. Numerous problems and difficulties are encountered during such vertically oriented operations.

SUMMARY OF THE INVENTION

The present invention is directed to an extremely efficient method for handling, manipulating, and utilizing tubular members such as casing, tubing, and drill pipe. The method overcomes the disadvantages of vertically-oriented operations.

The method of the present invention teaches the handling of drill pipe, tubing or casing in a horizontal plane above the surface of the sea or land. The method is efficient and safe for drilling operations and for running operations. The method can be employed to work with single conventional pieces of pipe at a time, but it is very advantageous to use the method with strings made of a plurality of pieces. Also, extended length tubulars may be used to reduce the number of leak-vulnerable connections in the string. The method includes the steps of connecting together a plurality of pieces such as casing or tubing in the horizontal plane above the surface of the medium to be worked; supporting the resulting string or piece; or, if a single piece is to be handled, positioning the single piece in the horizontal plane above the surface so that it can be moved; positioning one end of the string or piece at the point of insertion into the medium to be worked; connecting the other end of the string or piece to a prime mover which moves the string or piece in the horizontal plane; inserting the string or piece into the medium at the point of insertion at a slight angle from the horizontal; moving the string or piece into the medium by means of the prime mover; manipulating the string or piece while it is in the medium by means of a rotational mover attached to the string or piece; and, if desired, pulling the connected string or parts thereof or the piece out of the medium by means of the prime mover.

This method makes possible the handling of a single piece or of complete pre-assembled strings of tubulars above the surface. The string or large sections of the string preassembled above the surface can also be tested above the surface. This above-the-surface testing is more economical, more effective and more efficient than in-bore testing. Leaks can be directly observed and repaired prior to use.

In a typical sea operation a riser extends from the mouth of the wellbore on the seabed to a surface vessel, such as a barge, which may also serve as a mud return vessel. The tubing or casing to be run down through the riser into the wellbore extends from a prime mover aligned with the mud return vessel, through the mud return vessel, through the riser, and into the wellbore. A plurality of pieces of tubulars can be pre-assembled and then moved by the prime mover through the mud return vessel and through the riser into the wellbore. Equipment to rotate the strings of tubular can be conveniently located either on the mud return vessel, on the prime mover, or on a third vessel. Other rotational devices such as the commercially available Dynadrill may be used in this method.

Since the mud return vessel and prime mover are on the surface, the riser can be connected to a template over the wellbore so that it will swivel as the position of the vessels and string shift with the current or weather conditions. Alternately, the mud return vessel can be anchored so that it is relatively immobile and a fixed template can be used. Surface or submerged flotation devices may be used to support the riser or the riser can be free-form without any such devices. The riser may also, if desired, have pre-formed sections when a specific configuration such as a pre-formed arc curvature is desired. Independent trusses running along the riser from the mud return vessel to the template may also be employed to provide added structural strength to the riser. Also if desired a mud transfer line may be used between the mud return vessel and the prime mover. When it is desired to remove a string from the wellbore the prime mover simply backs off the appropriate distance from the mud return vessel thereby pulling the desired length of the string from the wellbore.

Land operations are similar to sea operations. Tubulars are made to enter the earth at a slight angle from the horizontal. By employing suitable equipment for rotating and for handling drill equipment, drilling operations may be performed quickly and efficiently according to the present invention. One advantage is the significantly reduced time for removing and reinserting whole tubular strings in a wellbore as, for example, when a worn drilling bit must be replaced.

A specific advantage resulting from the use of the present invention is the prevention of an undesirable effect known as "mud caking" which occurs in conventional wells. After a wellbore has been drilled in the conventional manner, drilling mud fills both the wellbore and the pipe or casing extending down into the wellbore. Cement is then pumped down the pipe, forcing the drilling mud out the bottom of the pipe. This cement goes down the pipe, exits the pipe at the bottom of the wellbore, and then begins to go upward in the wellbore outside the pipe. As the cement goes upward, the drilling mud is pushed ahead of the cement. While this process is taking place, a layer of drilling mud can be deposited on the exterior surface of the pipe, even though the majority of the volume of the wellbore is filled with cement. This layering of mud is known as "mud caking" and it can contribute to undesirable conditions in a well; for example, it can lead to inter-reservoir contamination or communication. If the producing formation is water sensitive, valuable oil reserves may be sealed off from production through the wellbore by this inter-reservoir contamination.

The present invention can be used to prevent mud caking. Before any pipe is run into a newly-drilled wellbore, cement is pumped into the wellbore. At the surface, the string of pipe, tubing, or casing is prepared which will be run into the wellbore. A plug is placed in the bottom of the string to prevent any cement from flowing into the string as it is run into the well. The pre-assembled string is then run into the wellbore by the prime mover. As the plugged string reaches the cement, the excess cement is displaced upward and out of the well. This operation is done quickly and the time necessary to complete it is minimal relative to the time required to run a string in the conventional manner. In this manner, the casing is never exposed to mud or possible caking. Alternatively, a desired quantity of cement can be introduced into a wellbore that contains some mud and the same operation carried out. Even in this alternate manner, the exposure of the casing to the mud is significantly reduced.

By using horizontal locomotion to install and remove strings, many of the disadvantages and problems of vertical operations are overcome.

It is, therefore, an object of the present invention to provide a method for the horizontal handling of tubular members such as casing and tubing at the surface.

Another object of the present invention is the provision of a method in which individual pieces of or strings of pipe, casing or tubing can be pre-assembled above the surface prior to installation in a wellbore.

Yet another object of the present invention is the provision of a method in which a pre-assembled string can be tested either by instrument or visually prior to installation in a wellbore.

A further object of the present invention is the provision of a method which employs a prime mover to move a string or piece horizontally to install it in the wellbore.

A still further object of the present invention is the provision of a method in which a prime mover moves a string or piece horizontally to remove the string or piece from a wellbore.

An additional object of the present invention is the provision of a method by which a string or piece can be efficiently run into a wellbore with the string or piece being handled at the surface in the horizontal plane.

Another object of the present invention is the provision of a method in which a string can be removed from a wellbore without the necessity of disassembling the string into separate members.

Yet another object of the method according to the present invention is the reduction of the time required to remove a string or piece from a wellbore or the time required to run a string or piece into a wellbore.

Still another object of the method according to the present invention is the reduction or elimination of mud caking.

Another object of the present invention is the provision of a method in which a free-form curved riser and drilling conduit may be used which extend from a template on the sea floor to a mud return vessel on the surface.

A further object of the present invention is the provision of such a method in which the curved riser is either surface or submerged flotation supported.

An additional object of the present invention, is the provision of a method in which a pre-formed riser may be used in sea operations.

A still further object of the present invention is the provision of a method in which a riser may be employed which swivels to accommodate changes in current or changes in weather conditions that cause other equipment employed in carrying out the method to change position.

A particular object of the present invention is the provision of such a method wherein independent trusses may be used in conjunction with the riser.

Another object of the present invention, is the provision of such a method wherein means for rotating the string in the wellbore can be positioned on the surface as desired.

Other and further objects, features, and advantages will be apparent from the following description of the presently preferred embodiments of the invention, given for the purpose of disclosure, when taken in conjunction with the accompanying drawings.

DESCRIPTION OF THE DRAWINGS

In the attached drawings the several views are as follows.

DESCRIPTION OF TWO PREFERRED EMBODIMENTS

For purposes of disclosure, the method of the present invention will be described as applied in both sea and land operations.

Figure 1:
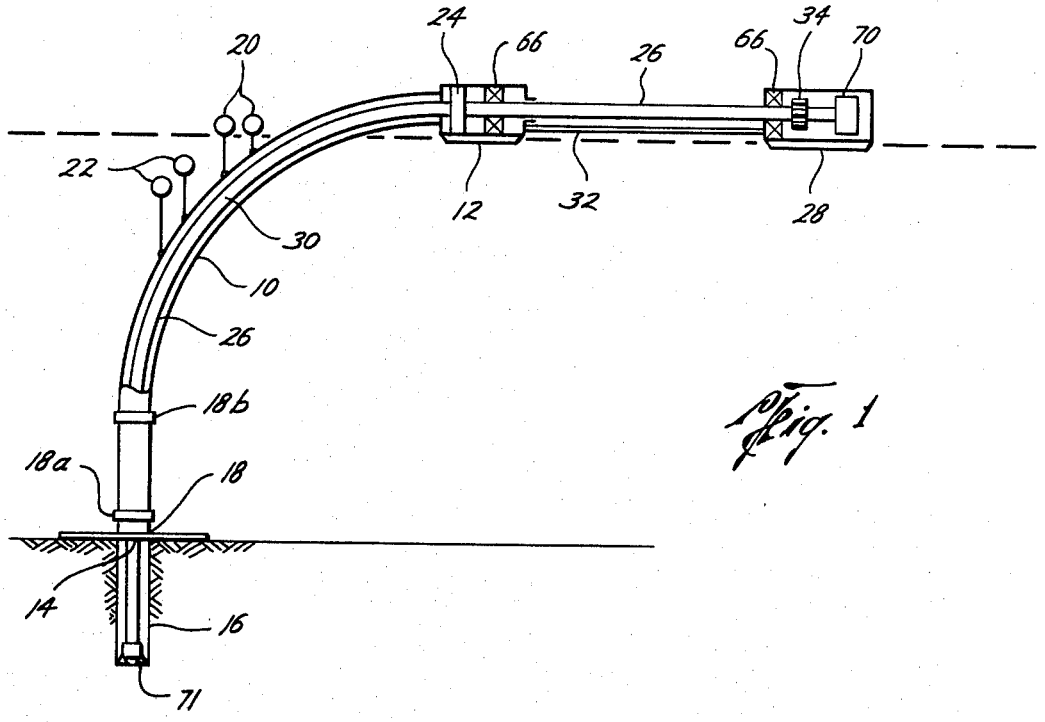
FIG. 1 is a schematic view of a seabed operation according to the method of the present invention.

Turning now to FIG. 1, FIG. 1 illustrates a typical sea operation according to the method of the present invention. A riser 10 is connected at the water's surface to a mud return vessel 12 and at the mouth 14 of the wellbore 16 to the swivel template 18 which is mounted over the mouth 14. The riser 10 can be free-form as illustrated in FIG. 1 since pipe will arc naturally over a particular length. For example, twenty-inch outside diameter casing will arc at the rate of twenty-five degrees for every one hundred feet of length (25°/100 feet or 25°/30.3 meters). A pre-formed riser may be used which employs sections already formed to the desired arc. The entire riser can be pre-formed or separate sections only may be pre-formed.

Flotation devices may be employed to help support the riser. Both the surface flotation devices 20 and the submerged flotation device 22 are illustrated in FIG. 1. A blow-out preventer 24 is secured at the end of the riser 10 where it is connected to the mud return vessel 12.

The drillstring 26 having the drilling bit 71 extends from the wellbore 16 through the riser 10, through the mud return vessel 12 to a prime mover 28. The drillstring 26 runs through suitable bearing supports 66 in both the mud return vessel 12 and in the prime mover 28. By moving toward the mud return vessel 12, the prime mover 28 moves the drillstring 26 further into the wellbore. By moving away from the mud return vessel 12, the prime mover 28 removes the drillstring from the wellbore 16 and upward in the riser 10. Safe removal can be done at speeds such as 250 feet of drillstring per minute. For example, the drillstring from a 10,000 foot well could be removed in 40 minutes. Well control fluid such as drilling mud must be pumped into the wellbore at a rate sufficient to compensate for tubular withdrawal. The speed of tubular withdrawal is limited only to a speed which will not cause the wellbore to be emptied ("swabbed"). The speed of insertion is limited only to a rate which will not cause breakdown of low pressure (friable) formations. In contrast, using conventional methods, removal of drillstring from a 10,000 foot well would require 6 to 8 hours. A similar time saving is realized when the drillstring is run back into the well so that, by comparison, using the method of the present invention requires 80 minutes for a "round trip," but, using conventional methods, such a round trip may range from 12 to 16 hours. To minimize any likelihood that the tubular string would become obstructed, such as by "differential sticking," the pipe may be continually or intermittently rotated during the removal and/or running operations.

Drilling mud 30 fills the drillstring 26, the riser 10 and the wellbore 16. The mud 30 flows down the drillstring 26 into the wellbore 16 and back up the riser 10 to the mud return vessel 12. The mud 30 is pumped by the mud return vessel 12 through the mud transfer line 32 to the prime mover 28. Mud is then pumped from the prime mover 28 down the drillstring 26 by means of pump 70. The mud transfer line 32 extends from the mud return vessel 12 to the prime mover 28.

The prime mover 28 as shown in FIG. 1 has conventional rotational equipment 34 for rotating the drillstring 26. It is to be understood that this positioning of the rotational equipment is optional and that the equipment can also be located on the mud return vessel or on a third vessel.

The template 18 has a swivel **18*a* so that the riser 10 may swivel to accommodate changes in current or in weather conditions which shift the position of the equipment or vessels. It is to be understood that the method of the present invention may be carried out without the use of a swivel template. Under certain conditions a fixed template and a fixed riser would be appropriate and would not depart from the scope of the present invention. As shown in FIG. 1, another swivel such as swivel 18*b*** may be employed so that one portion of the riser is movable with respect to another portion.

Figure 2:
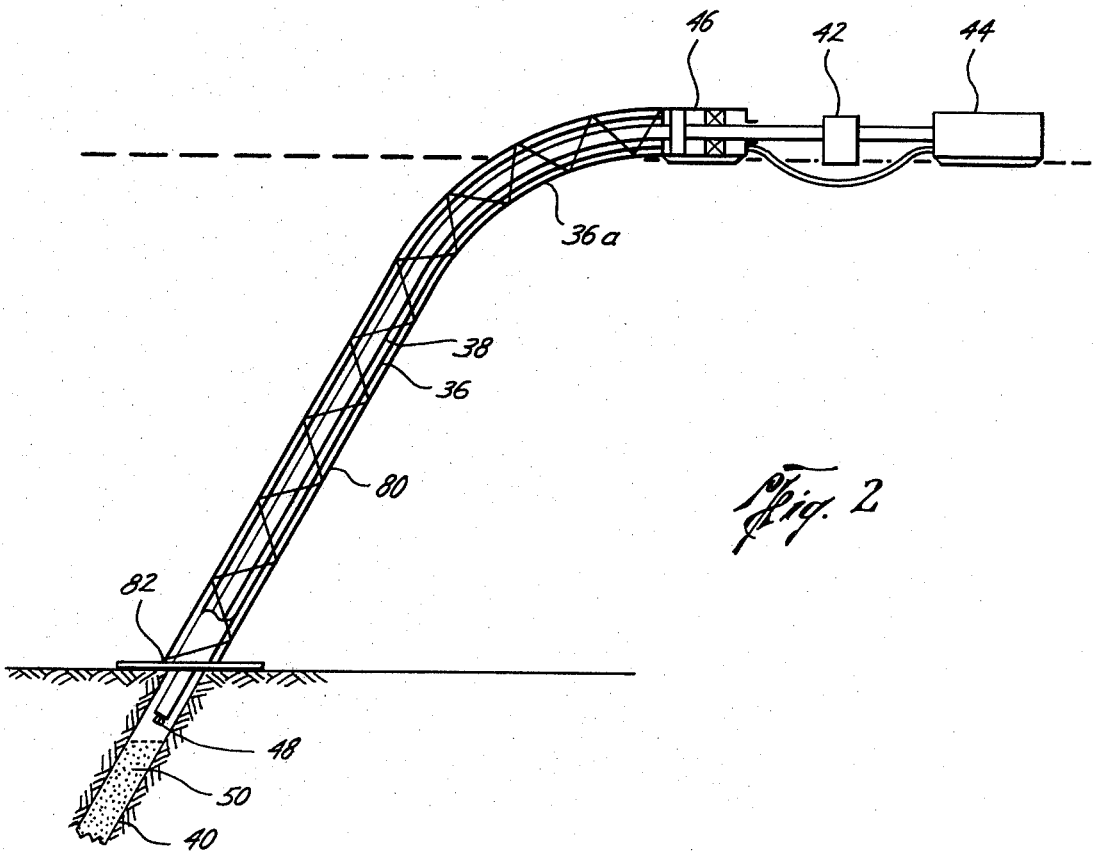
FIG. 2 is a schematic view of a sea operation illustrating the running of casing into a wellbore on the sea floor.

Referring now to FIG. 2, riser 36 has a pre-arced portion **36*a* which has a pre-formed bend. A string of casing 38 has been pre-assembled and is being run into the wellbore 40 by the prime mover 44. An appropriate flotation device 42 has been positioned around the string 38 so that the string 38 does not bow downward between the mud return vessel 46 and the prime mover 44. The independent truss 80 extends from the mud return vessel 46 to the template 82 providing strength and protection for the riser 36**.

As illustrated in FIG. 2, the method of the present invention may be employed where the sea floor is so close to the surface that there is not enough depth for the riser 36 to arc freely to a point at which it enters the sea floor at or near the perpendicular. The wellbore 40 is drilled at an angle and the riser 36 is angled so that the string 38 passes through the riser 36 and enters the wellbore 40 smoothly. Even in locations where the sea depth is sufficient to allow perpendicular penetration, a wellbore can be drilled at any angle without departing from the scope of the present invention.

For cementing operation, the interior of the string 38 is empty, as shown in FIG. 2, and the plug 48 seals the end of the string 38 that is run into the wellbore 40. Cement 50 has been pumped into the wellbore replacing the mud such that the introduction of the string 38 will be directly into the cement 50. The string 38 is inserted into the cement 50. As the string 38 enters the cement 50 and pushes cement upwards, excess cement will flow to the mud return vessel 46. It is to be understood that a string can be run into a well according to the method of the present invention without plugging the string and with mud in both the string, the riser, and the wellbore without departing from the scope of the invention.

Figure 3:
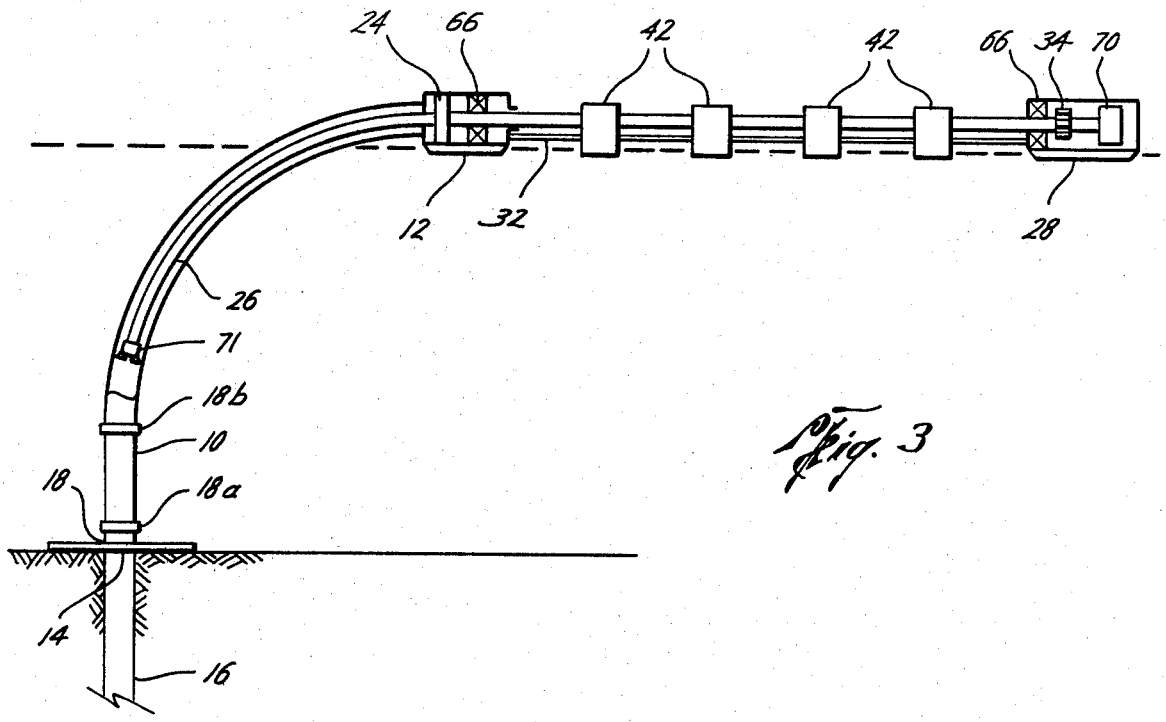
FIG. 3 is a schematic view of a sea operation illustrating the removal of a drillstring from a wellbore on the sea floor.

FIG. 3 illustrates the removal of drill string 26 of FIG. 1 from wellbore 16 and riser 10. The prime mover 28 has moved away from the mud return vessel 12, pulling out the drillstring 26. The flotation devices 42 have been installed on the length of drillstring 26 between the mud return vessel 12 and the prime mover 28.

Figure 4:
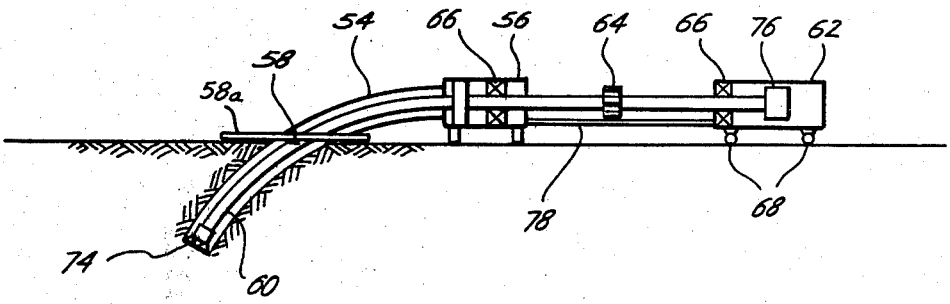
FIG. 4 is a schematic view of a land operation according to the method of the present invention.

A land drilling operation according to the method of the present invention is illustrated in FIG. 4. The template **58*a* is secured at the earth's surface 58 and one end of the riser 54 is connected to the template 58*a*. The riser 54 arcs from the mud return vessel 56 to a location on the surface 58. The drillstring 60 having drilling bit 74 connected thereto extends from the prime mover 62 through the rotational equipment 64, the mud return vessel 56, and the riser 54 into the earth. The drillstring 60 enters the earth at the location 58. The drillstring 60 runs through suitable bearing supports 66 in both the mud return vessel 56 and the prime mover 62. The prime mover 62 is mounted on wheels 68 and can run on the ground as shown in FIG. 4 or can run on rails (not shown). Mud return line 78 extends from mud return vessel 56 to prime mover 62. Appropriate rotational and mud handling equipment 76 is connected to the drillstring 60**.

As can be seen from FIG. 4, land operations according to the method of the present invention are essentially similar in concept to sea operations according to the same method. On land the prime mover for moving a string in the horizontal plane could consist of a system of tracks with a pulling mechanism at the end of the tracks remote from the wellbore with a cable or similar means for attaching to the string such that as the string is pulled out, it is placed on cars that roll on the tracks with the pulling mechanism remaining stationary at the end of the tracks. In some special situations it might be appropriate to combine aspects of the sea operation and land operation; for example, with a well close to shore such a combination could be advantageous.

What is claimed is:

1. A method for running a string of pipe into a wellbore having its mouth on the seafloor wherein the wellbore is full of drilling mud including the steps of securing a template over the mouth of the wellbore, connecting to the template one end of a riser that arcs from the sea surface to the template, connecting the other end of the riser on the surface to a mud return vessel, filling the wellbore to a desired level with cement, the cement displacing a proportionate amount of drilling mud upward positioning one end of the string of pipe movably in the mud return vessel, connecting the other end of the string to a prime mover on the surface, sealing the end of the string to be inserted into the wellbore by means of a plug to insure that the space enclosed by the string remains empty during insertion of the string, so that the insertion of the string displaces the cement upward in the wellbore, and moving the prime mover toward the mud return vessel thereby moving the string through the mud return vessel, through the riser and into the wellbore.

2. The method of claim 1 including also the step of testing the string of pipe prior to running it into the wellbore.

3. A method for running a string of pipe into a wellbore having its mouth at the earth's surface, the wellbore extending downward at an angle slightly from the horizontal, and wherein the wellbore contains a quantity of drilling mud, the method including the steps of securing a template over the mouth of the wellbore, connecting to the template one end of a riser, connecting the other end of the riser to a mud return vessel, the riser arcing from the mud return vessel to the mouth of the wellbore so that the string can be inserted smoothly through the riser into the wellbore, filling the wellbore to a desired level with cement, the cement displacing a proportionate amount of the drilling mud upward, positioning one end of the string of pipe movably in the mud return vessel, connecting the other end of the string to a prime mover that is substantially aligned with the mud return vessel, sealing the end of the string to be inserted into the wellbore by means of a plug to insure that the space enclosed by the string remains empty during insertion of the string so that the insertion of the string displaces the cement upward in the wellbore, moving the string in the horizontal plane toward the mud return vessel by means of the prime mover thereby moving the string through the riser into the wellbore.

4. The method of claim 3 including the step of testing the string before it is run into the wellbore.

* * * * *